United States Patent [19]

Hunsberger et al.

[11] Patent Number: 4,490,105

[45] Date of Patent: Dec. 25, 1984

[54] FUEL SUPPLY SYSTEM FOR A RECIRCULATING FUEL BURNER

[75] Inventors: Dale L. Hunsberger; Frank L. Harwath, both of Rockford, Ill.

[73] Assignee: Sundstrand Corporation, Rockford, Ill.

[21] Appl. No.: 385,215

[22] Filed: Jun. 4, 1982

[51] Int. Cl.[3] ..... F23D 5/16

[52] U.S. Cl. ..... 431/65; 431/89; 431/118; 222/318; 239/127

[58] Field of Search ..... 431/65, 89, 117, 118; 137/563; 222/318; 239/124, 127; 123/510, 514

[56] References Cited

U.S. PATENT DOCUMENTS 2,724,433 11/1955 Witherell ..... 239/127
3,051,227 8/1962 Robson ..... 431/89
3,425,058 1/1969 Babington ..... 431/117
4,175,527 11/1979 Sanada et al. ..... 123/514

*Primary Examiner*—Carroll B. Dority, Jr.
*Attorney, Agent, or Firm*—James A. Wanner; Ted E. Killingsworth; Michael B. McMurry

[57] ABSTRACT

The present invention is directed to a fuel supply system for a fuel burner of the type that requires for proper operation an excess flow of fuel to be provided to the burner with that excess being recirculated. The fuel system further requires that sufficient fuel is added to the system to make up for that amount of fuel which is fired or burned. The fuel supply system includes a fuel pump which selectively draws from a fuel supply the make-up fuel flow and from a return path the excess fuel flow for recirculation. At any given moment all fuel flow from one inlet line and the other inlet line is positively closed.

16 Claims, 6 Drawing Figures

FUEL SUPPLY SYSTEM FOR A RECIRCULATING FUEL BURNER

FIELD OF THE INVENTION

The present invention is directed to a fuel supply system for a fuel burner of the type that requires for proper operation an excess flow of fuel to be provided to the burner with that excess being recirculated. The fuel system further requires that sufficient fuel is added to the system to make up for that amount of fuel which is fired or burned.

BACKGROUND OF THE INVENTION

Recirculating fuel burners are well known and are exemplified by U.S. Pat. Nos. Babington 3,425,058 issued Jan. 28, 1969, Babington et al 3,751,210 issued Aug. 7, 1973, and Babington 4,155,700 issued May 22, 1979. These patents are directed to fuel burners wherein a quantity of fuel greater than that to be burned is supplied to a fuel diffuser assembly normally in the shape of a sphere where the fuel supplied forms a thin film over the diffuser. Pressurized air from within the sphere then exits through small apertures to act on the thin film of fuel to atomize that small portion of fuel near or over the apertures. The excess fuel drains from the sphere into a collector and is then returned to a fuel tank, or in the case of U.S. Pat. No. 3,751,210, is returned to the fuel pump for recirculation. FIG. 2 of this last mentioned patent furthermore shows a reservoir which acts as a flow divider to sequentially deliver fuel to different fuel atomizers and to drain. The disclosures of these three U.S. patents teach one form of a recirculating fuel burner wherein a small percent of the fuel supply to the atomizer is burned and the excess fuel is recirculated. The present invention is directed to a fuel supply system for use with such a recirculating fuel burner.

It is furthermore known to use a single pump as a fuel supply for a recirculating fuel burner wherein the pump has an inlet connected both to a fuel tank line and to a return line from the collector. In such a system there must be some selectivity as to when the pump is utilized to pump the excess fuel from the collector or to pump make-up fuel from the fuel tank. Such system has a spring biased diaphram valve which acts as a return fuel control and is responsive to the fuel pressure head in the collector upstream of the valve to determine when the fuel pump is used to recirculate the excess fuel from the collector. The pump inlet also is connected to the fuel tank by a spring biased vacuum valve which is responsive to suction at the pump inlet to permit flow of make-up fuel from the tank. The pump, which is driven by the air compressor shaft and which carries the return fuel control valve, is positioned in such a manner due to the physical restraints of the system that the pressure head operating on the spring biased diaphram level control valve is quite low and in the neighborhood of two to three inches. This reduced the reliability of the system due to the low pressure head being measured and due to the inherent tolerance problems with spring biased valves. Such system reliability is further reduced due to the adverse effects of temperature, fuel viscosity or fuel density. Differences in temperature, especially extreme cold, not only effect the resiliency of the diaphram but also change the fuel characteristics. Furthermore different fuels, or the same fuel under different temperature conditions, have different densities which effect the fuel head or the fuel level required to operate the valve. It is also noted that some fuel oils contain aeromatics which adversely effect the rubber diaphram and the sealing edges.

Furthermore the make-up fuel flow from tank is responsive to the suction at the pump inlet which in turn was responsive to the unstable operation of the return fuel control valve. This causes a modulation of the tank suction valve which generates a relatively low volume flow of make-up fuel on a substantially continuous basis. Since the inlet line must be of sufficient size to allow substantial flow for pump start-up and system purging, this relatively low flow does not generate sufficient fluid velocity to purge air from the inlet line which in turn causes potential cavitation problems.

SUMMARY OF THE PRESENT INVENTION

The present invention is directed to a fuel supply system for a recirculating fuel burner wherein the single pump is used to provide both make-up fuel flow from a fuel tank and also recirculating fuel flow from a fuel collector wherein only one of the fuel inlets to the pump is open at any given time and the shut-off to the other fuel inlet is positive.

It is a primary object of the present invention to provide a fuel supply system for a recirculating fuel burner having a single fuel pump which selectively draws fuel from either the fuel tank or the fuel return line and wherein such selective operation is both positive and responsive to the level of excess fuel that is collected.

It is furthermore an object of the present invention to provide a single pump fuel system for a recirculating fuel burner wherein the tank fuel line is sufficient size to provide full fuel flow for pump start-up and yet assuring sufficient make-up fuel flow when such tank line is open that air is evacuated from the line to reduce pump cavitation damage.

It is a further object of the present invention to provide a fuel supply system for a recirculating fuel burner wherein pump location and drain location are not critical.

It is another object of the present invention to provide a fuel supply system for a recirculating fuel burner which eliminates the need for a vacuum valve at the pump inlet which was previously necessary to prevent overflow caused by a pressure head generated by an elevated fuel tank and where any valving of the fuel tank inlet line is positive.

It is further an object of the present invention to provide a flow divider in the fuel supply system for a recirculating fuel burner which generates a higher initial flow to the fuel burner at the beginning or initiation of each cycle.

It is also an object of the present invention to provide a fuel supply system for a recirculating fuel burner wherein the supply of fuel to the burner is not viscosity sensitive.

It is furthermore an object of the present invention to provide a fuel supply system for a recirculating fuel burner, the recirculating fuel burner being of the type that requires a burner fuel flow in excess of the fuel burnt and wherein the excess fuel may be recirculated for further use, the fuel supply system including a pump having a flow capacity equal to or greater than the burner fuel flow, a fuel supply, a supply line connecting the supply to the inlet of the pump, the pump being upstream of the burner and providing fuel flow to the burner, a collector downstream of the burner for collecting the excess fuel, a return line connecting the collector and the inlet of the pump, a valve controlling the flow from both the supply line and the return line to the inlet of the pump wherein the supply line is normally closed by the valve and the return line is normally open, and a fuel level sensing means sensing the level of fuel in the collector and operatively connected to the valve whereby the sensing means causes the valve to open the supply line and close the return line upon sensing the level of fuel in the collector reaching a predetermined level.

Also an object of the present invention is to provide a fuel supply system for a recirculating fuel burner, the recirculating fuel burner being of the type that requires a burner fuel flow $F_n$ in excess of the fuel fired $F_f$ and wherein the excess flow may be recirculated for further use, the fuel supply system including a pump having a flow capacity $F_p$ equal to or greater than $F_n$, a fuel tank, a tank line connecting the tank to the inlet of the pump and having a flow capacity equal to or greater than $F_p$, a flow divider connected to the output of the pump and providing a flow $F_n$ directed toward the burner and an excess pump flow $F_e$ diverted from the burner wherein $F_n+F_e=F_p$, a collector downstream of the burner for collecting both the flow $F_e$ and the flow $F_n$-$F_f$, a return line connecting the collector and the inlet of the pump, a valve controlling the flow from both the tank line and the return line to the inlet of the pump wherein the tank line is normally closed by the valve and the return line is normally open, and a fuel level sensing means sensing the level of fuel in the collector and operatively connected to the valve whereby the sensing means causes the valve to fully open the tank line and totally close the return line upon sensing the level of fuel in the collector reaching a predetermined level.

DESCRIPTION OF THE PREFERRED EMBODIMENTS

Figure 1:
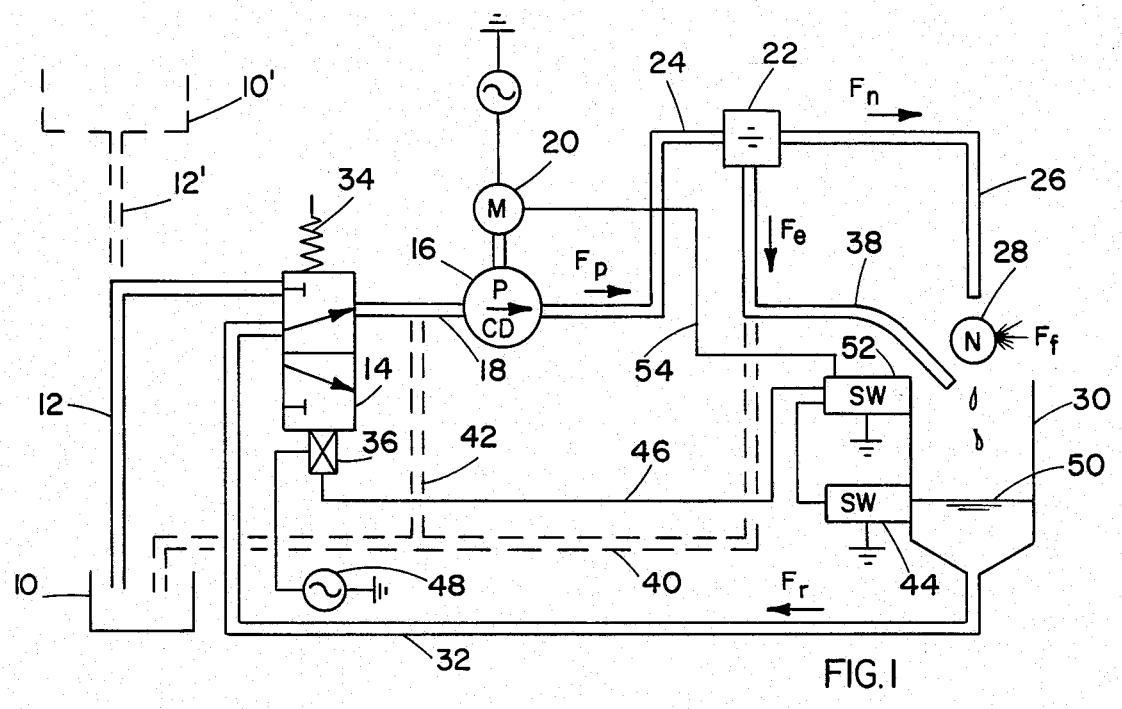
FIG. 1 is a schematic view of the fuel supply system of the present invention as used with a recirculating fuel burner.

The fuel supply system of the present invention as used with a recirculating fuel burner is shown in FIG. 1. A fuel tank 10 provides a supply of fuel to a tank line 12 which leads to a two position valve 14. In the alternative, an elevated fuel tank 10' with a positive pressure head can provide a supply of fuel to the valve 14 through tank line 12'. A constant flow pump 16 is connected to the valve 14 by a pump inlet 18 represented in FIG. 1 as a line although in normal practice, the inlet 18 will be a passageway integral with the pump housing. The pump 16 is driven by a motor 20 to provide a pump flow $F_p$ to a flow divider 22 connected to the pump outlet by line 24. The flow divider 22 may be of several forms shown in more detail in FIGS. 2A through 2D. The pump flow $F_p$ is separated into two flows by the flow divider 22. The first of these two flows is referred to herein as nozzle fuel flow $F_n$ which passes along line 26 to the burner nozzle 28. The nozzle flow $F_n$ is greater than the fuel fired or burned at the nozzle 28 referred to as $F_f$. The fuel flow $F_n$ from line 26 is directed at the spherical nozzle 28 and forms a thin film over the nozzle 28. Pressurized air flow is utilized to atomize a portion of the fuel on the nozzle 28 and is provided by an air compressor (not shown) which may also be driven by the motor 20. The fuel fired $F_f$ is generally a relatively low percentage of the fuel supplied to the nozzle $F_n$. The fuel not burned is referred to as the excess burner flow and is represented by ($F_n$-$F_f$) The excess burner flow ($F_n$-$F_f$) drops from the nozzle 28 and is collected by a collector 30. The collector 30 is provided with a fuel return line 32 having a return flow $F_r$. This fuel return line 32 is also directed to the two position valve 14 which controls the return flow $F_r$ to the pump inlet 18 whereby the collected fuel can be recirculated by the pump 16.

The two position valve 14 has a first position as shown in FIG. 1 wherein tank line 12 is closed and the fuel return line 32 is open. The valve 14 also has a second position, opposite to that shown in FIG. 1, wherein the fuel return line 32 is closed and the tank line 12 is open to permit flow from the tank 10 to the pump inlet 18. Preferrably the two position valve 14 is a solenoid valve which is biased to the first described position by a spring 34 and operated by a solenoid 36 to move the valve to the second above described position against the bias of the spring 34. The solenoid valve 14 is commonly referred to as a three-way solenoid valve which alternately selects full flow from one of two inlet lines to a single outlet line and wherein the flow from the other of the inlet lines is positively blocked. The use of such three-way solenoid valve assures that at any given moment all flow to the pump 16 is from either tank line 12 or return line 32 and that there is no flow from the other line which at that moment is not connected to the pump inlet 18.

Also part of the fuel flow system is a line 38 which connects the flow divider 22 with the collector 30 located downstream of the nozzle 28. The fuel which is not directed to the nozzle through line 26 flows through line 38 and completely by-passes the nozzle 28. This fuel is referred to as excess pump flow $F_e$. It can be readily seen that the relationship between the pump flow $F_p$, the nozzle flow $F_n$ and the excess pump flow $F_e$ meets the equation $F_p=F_n+F_e$. The excess pump flow $F_e$ which by-passes the nozzle 28 is collected in collector 30 along with the excess burner flow ($F_n$-$F_f$) and it is these two flows which make up the fuel return flow $F_r$ which is then directed along return line 32 to be recirculated by the pump 16.

It is noted by the dotted lines of FIG. 1 that the excess pump flow $F_e$ may not only by-pass the nozzle 28 but may also by-pass the collector 30. One alternative flow for the excess pump flow $F_e$ is along fuel line 40 shown by dotted lines back to the fuel tank 10. Another alternative flow path for the excess pump flow $F_e$ is along fuel line 40 and alternative dotted line 42 (shown in dotted lines) directly to the inlet 18 of the pump 16. In this second alternative flow path, the excess pump fuel $F_e$ does not go to either the collector 30 or the tank 10 but is directly recirculated by the pump 16. In this alternative construction, the flow divider 22 and the fluid lines 40 and 42 are all integral with the pump 16 as will be later described in detail in the discussion of the fuel pump shown in FIG. 3.

It can thus be seen that the different fuel flows in the fuel supply system of FIG. 1 are all interrelated. The fuel pump flow $F_p$ is equal to the fuel nozzle flow $F_n$ plus the excess pump flow $F_e$. If the excess pump flow $F_e$ is directed to the collector 30 by line 38 as shown in solid lines of FIG. 1, the return fuel flow $F_r$ is equal to the nozzle fuel flow $F_n$ minus the fuel fired $F_f$ plus the excess pump flow $F_e$ which in turn is equal to the pump flow $F_p$ minus the fuel fired $F_f$. Thus, it can be seen that the fuel returned $F_r$ is equal to the pump fuel flow $F_p$ minus that small amount of fuel fired $F_f$. If for example the $F_f$ is 3% of the total fuel pumped $F_p$ then $F_r$ is equal to 97% of $F_p$. In order to make up for the fuel fired $F_f$, an equal percent of fuel must be drawn from the tank 10 through line 12. Since either line 12 or line 32 is always closed and thus the open line is providing the total pump flow $F_p$, it can be seen that for this example the fuel return line 32 must be open 97% of the time while the tank line 12 is open only 3% of the time. However, it is noted that during this 3% of the time, the tank line 12 is fully open and receives the total pump flow $F_p$.

It is important that the tank line 12 is subjected to total pump flow $F_p$ even though it be for only short time duration. The tank line 12 must be of sufficient size to carry total pump flow $F_p$ during the initial pump start-up. If line 12 has too small of a cross section, there may be pump starvation at the inlet of the pump 16 which causes cavitation damage to the pump 16 thus limiting its life. It is also important during initial pump start-up that a sufficient flow $F_p$ is provided from the tank 10 to quickly saturate the surface of the nozzle 28 to assure both quick start-up times and also assure proper operation of the burner nozzle 28. While a large flow capacity for line 12 is desirable during pump start-up, it is undesirable for low flow conditions. Insufficient flow through a line does not thoroughly flush the line and allows for air pockets to be created. As can be seen from the description above, when the two position valve 14 is biased against the spring 34 by the solenoid 36, the tank line 12 is totally open and carries full pump flow $F_p$ thus assuring sufficient flow through the line 12 to prevent the creation of air bubbles. Thus it is important that the two position valve 14 does not modulate the flow through the two inlet lines 12 and 32 but totally closes one line while fully opening the other line even if the tank line 12 is only open for very short time durations.

When the pump excess flow $F_e$ by-passes the collector 30 by flowing to tank 10 through line 40, the return flow $F_r$ is now equal to excess burner flow ($F_n$-$F_f$). If pump flow $F_p$ is exactly equal to nozzle flow $F_n$, then there is no excess pump flow and $F_e$ is equal to zero. Under such a condition, the fuel return flow $F_r$ is $F_p$ minus $F_f$ and thus tank line 12 need only be open that percentage of time necessary to make up sufficient fuel for that fuel fired $F_f$. If the pump fuel flow $F_p$ is greater than the nozzle flow $F_n$, that excess pump flow $F_e$ is returned to tank 10 through line 40. The tank line 12 now supplies sufficient fuel to make up for that fuel fired $F_f$ plus the excess pump flow $F_e$ since only the excess burner flow ($F_n$-$F_f$) is recirculated.

In the second alternative return flow for the excess pump flow $F_e$ which utilizes both line 40 and line 42 to directly recirculate the excess pump fuel, again the return fuel flow $F_r$ is equal to excess burner flow ($F_n$-$F_f$) and it does not include excess pump flow $F_e$. It is noted that the tank line 12 now only provides make up fuel for that fuel fired $F_f$ the same as the first or solid line embodiment.

In order to assure that the two position valve 14 only opens line 12 for that period of time necessary to provide make-up fuel flow, a fluid level switch 44 is provided at the collector 30. The fluid level switch 44 may be of any conventional type that is designed to operate at a given fluid level height and preferrably having significant hysteresis to prevent rapid cycling of the switch. While magnetic reed float switches have been tested, other switches such as hinged float mercury switches or an air column type could also be employed. It is important, due to the low fuel head available in the collector 30 (in order to reduce total burner height), that any level switch utilized should be responsive to a low head. The switch 44 is connected via safety switch 52 and line 46 to the solenoid 36 and a source of electric power 48 which is normally line power. Upon initial pump start-up, there is little or no fuel in the collector 30 and the tank line 12 is open to provide the pump flow $F_p$ to fill and purge the system, including saturating the nozzle 28. During this period of time the switch 44 is closed activating the valve 36 to bias the valve against the spring 34 to assure that tank line 12 is open and return line 32 is closed. Once the fuel in collector 30 has reached level 50, shown in FIG. 1, switch 44 is opened deactivating the solenoid 36 so that spring 34 can bias the valve 14 to its normal position opening the return line 32 and positively closing the tank line 12. Now all flow for the pump 16 is through the return line 32 and there is no make-up fuel flow. As the fuel fired $F_f$ gradually diminishes the amount of fuel in the closed loop, the level line 50 will drop again closing the switch 44 to activate the solenoid 36 to open tank line 12 and close return line 32. Since the nozzle flow $F_n$ is significantly greater than the fuel fired $F_f$, the level 50 will quickly rise to open switch 44 to again position valve 14 in its normal position closing tank line 12.

The collector 30 is also be provided with a second fluid level switch 52 which is connected to motor 20 by line 54. The switch 52 acts as a safety switch to shut off pump 16 in case of system failure. The safety switch 52 also opens line 46 to insure that the solenoid 36 does not operate valve 14 to open tank line 12. This is especially important if the fuel supply is elevated, such as tank 10', and has a positive pressure head.

Now, in reference to FIGS. 2A to 2D, several different types of flow dividers are taught. The flow divider embodiment of FIG. 2A utilizes a fuel reservoir 56 having a lower outlet opening 58 and an upper outlet opening 60. The pump flow $F_p$ enters the reservoir 56 from line 24. When the reservoir 56 is empty such as at system start-up, all flow from the reservoir 56 will be nozzle flow $F_n$ limited by the size of the opening 58 and through line 26 to the nozzle 28. This quickly saturates the nozzle 28 to provide the thin film of fuel. Normally, the pump 16 is designed to have a higher capacity than the required nozzle flow and therefore $F_p$ is greater than $F_n$. The fuel level in reservoir 56 builds up until it reaches the higher orifice 60 which provides fuel flow $F_e$ through line 38 which is controlled by a variable valve 62. As one example of this embodiment, if $F_p$ equals 20 GPH, $F_e$ is varied from 18 to 12.5 GPH depending upon the position of the valve 62 and $F_n$ was the remainder of the flow and thus varied from 2 to 7.5 GPH. During the initial filling of the reservoir 56, $F_n$ approaches its upper limit of 7.5 GPH as determined by the size of opening 58, and the reservoir filled at a rate of 12.5 GPH until the fuel reached the level of the upper orifice 60. The rate of fuel fired $F_f$ is proportional to the thickness of the fuel film on the nozzle 28 which is proportional to the flow $F_n$. For a flow $F_n$ of 2 GPH, the fuel fired $F_f$ is approximately 0.3 GPH and for a nozzle flow $F_n$ of 7.5 GPH, the fuel fired $F_f$ is approximately 0.8 GPH. The fuel collected by the reservoir 30 is the excess flow $F_e$ plus the nozzle flow $F_n$ minus the fuel fired $F_f$. Thus for this example the fuel flow collected by the collector 30 would vary from 19.7 GPH to 19.2 GPH. The return flow $F_r$ over a given period of time would equal this flow rate although for any particular instance of time would either be 20 GPH, that is equal to the pump flow $F_p$, or zero GPH, dependent upon the position of valve 14 as regulated by the fuel level 50 activating the switch 44. It should also be noted at this point that with this embodiment of the flow divider the full pump flow can be attained through line 12 during initial pump start-up without the use of a purge valve as described later and shown in FIG. 3. No purge valve is necessary since any entrapped air will be separated in the reservoir 56 and the collector 30.

Figure 2B:
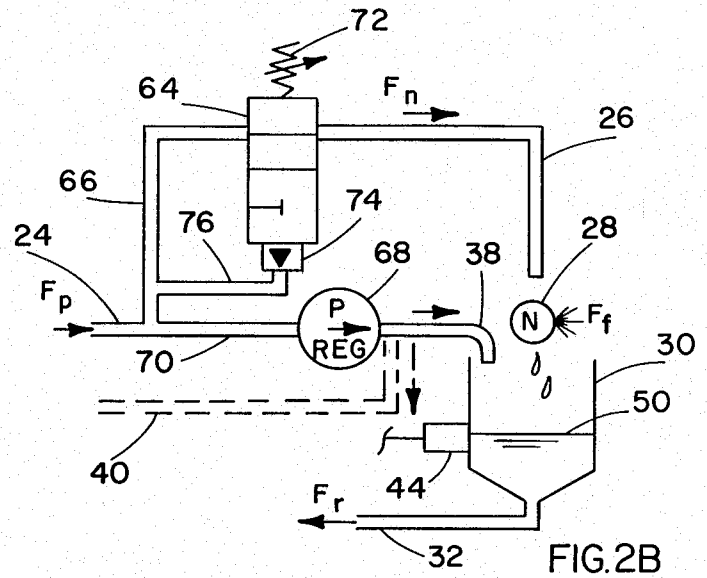
FIG. 2B is a schematic view of a second embodiment of a flow divider to be used with the system of FIG. 1.

In the flow divider embodiment of FIG. 2B, a pressure responsive valve 64 is utilized rather than the fuel reservoir 56. The pump flow $F_p$ from pump 16 and line 24 is directed to both the valve 64 through line 66 and a pressure regulator 68 through line 70. The pressure regulator 68 is generally integral with the pump 16 and modulates the excess pump flow $F_e$ that is allowed to pass through line 70 and determines the pressure in line 66. Valve 64 is normally biased to an open flow position by adjustable spring 72 and biased to a closed flow position by pilot 74 connected by line 76 to line 66. By adjusting the tension of spring 72 and the pressure regulator 68, the nozzle flow $F_n$ through line 66 and line 26 may be regulated. The excess pump flow $F_e$ may be directed to the collector 30 by line 38 or in the alternative returned to the tank or the pump inlet by line 40 as shown in FIG. 1. As an example of this type of flow divider system, the pump flow will generally be in the order of 20 GPH while $F_n$ again will vary from 2 to 7.5 GPH as per the previous example. Thus $F_e$ will vary from 18 to 12.5 GPH dependent upon the settings of the valve 64 and pressure regulator 68. The pressure compensated flow control valve 64 of this embodiment also is made to be self-compensating for viscosity and density changes of the fuel.

Figure 2D:
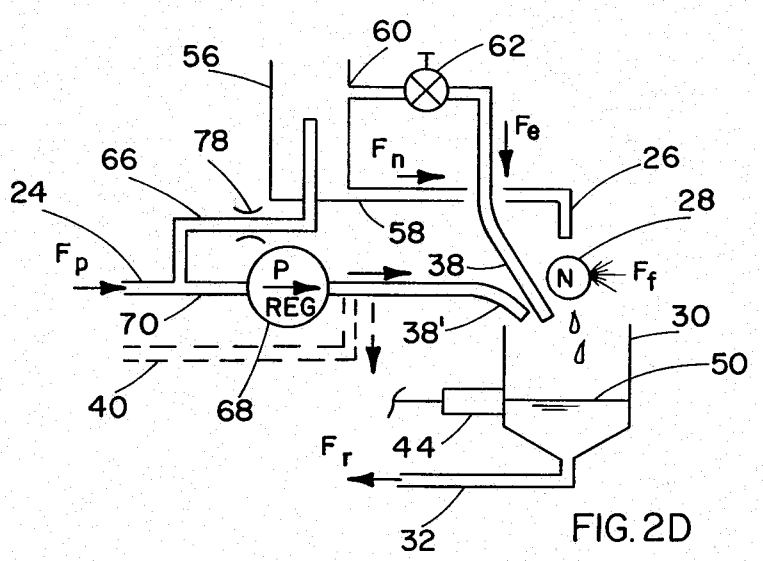
FIG. 2D is a schematic view of a fourth embodiment of a flow divider to be used with the system of FIG. 1.
Figure 2A:
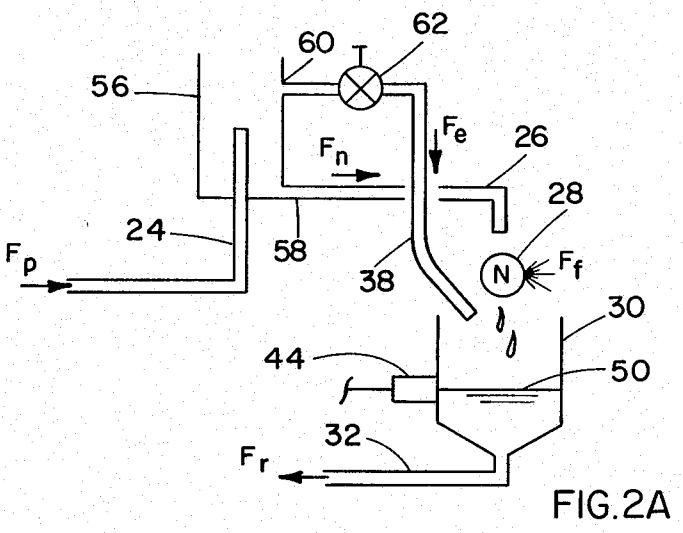
FIG. 2A is a schematic view of a first embodiment of a flow divider to be used with the system of FIG. 1.
Figure 2C:
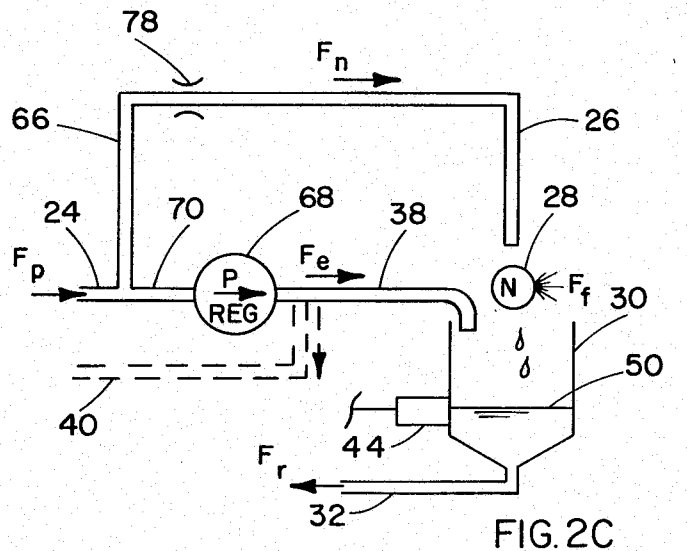
FIG. 2C is a schematic view of a third embodiment of a flow divider to be used with the system of FIG. 1.

The flow divider system of FIG. 2C also utilizes a pressure regulating valve 68 to modulate the pressure at the pump 16 outlet and the amount of excess pump flow $F_e$. However, the pressure regulator 68, rather than being in parallel with a flow control valve 64, is in parallel with a metering orifice 78. By regulating the setting of the pressure regulating valve 68, the flow through the metering orifice 78 and thus the nozzle flow $F_n$ through line 26 is controlled. Like the previous examples, the pump flow $F_p$ would be about 20 GPH, the nozzle flow $F_n$ would vary from 2 to 7.5 GPH with the difference equaling the excess pump flow $F_e$ which may be either directed to collector 30 through line 38 or returned to the pump inlet or tank through line 40.

In both of these examples, if the excess pump flow $F_e$ is directed to the collector 30, the return flow $F_r$ would equal the pump flow $F_p$ minus the fuel fired $F_f$. The return flow $F_r$ due to its connection to the pump inlet 18 through the valve 14 would either be equal to pump flow $F_p$ of 20 GPH or zero dependent upon the position of the valve 14 as regulated by the fluid level 50 in the collector 30. As the fuel fired $F_f$ varies from 0.3 to 0.8 GPH, the flow through line 32 would be 20 GPH for a period of time ranging from 98.5% to 96% total "ON" time, while the flow through the tank line 12 would vary from 1.5% to 4% of the time in order to provide sufficient make-up flow to equal fuel fired $F_f$.

If the excess pump flow $F_e$ is diverted back to the pump inlet 18 or to tank by line 40 and thus by-passes the collector 30, the return flow $F_r$ will be significantly reduced by the amount $F_e$. This means that the fuel collects less quickly in the collector 30. If the pump excess flow $F_e$ equals 60% of the pump flow $F_p$ and the flow $F_e$ is directed to the pump inlet, it will be directly circulated through the pump and thus only requiring 40% of pump flow $F_p$ coming through the valve 14. Under such a system flow path again only that flow sufficient to make up for fuel fired $F_f$ is provided through the tank line 12. However such flow will be at the flow rate of 8 GPH (that is $F_p$ at 20 GPH minus internally recirculated excess pump flow $F_e$ at 12 GPH) and time regulated by the level 50 of the fuel in the collector 30 which activates the switch 44. If the excess pump flow $F_e$ is directed by line 40 back to the tank 10, the regulation of the valve 14 will permit sufficient flow through line 12 to equal both the fuel fired $F_f$ plus the excess pump flow $F_e$ to pass through line 12.

The flow divider system of FIG. 2D is actually a combination of the fluid reservoir 56 of FIG. 2A and the flow dividing system of FIG. 2C. The pressure regulator 68 along with the metering orifice 78 is used to provide a first flow divider to regulate the fluid flow through line 66 to the intake of the reservoir 56. For a pump flow $F_p$ of 20 GPH, the pressure regulator 68 is manually set so as to provide a flow such as 8 GPH through the metering orifice 78. It is noted that 8 GPH is the same flow that was provided by the pump 16 through line 24 to the flow divider of FIG. 2A. The reservoir 56 with its two openings 58 and 60 and manually controlled valve 62 provide a second flow divider to determine the ratio of flow between nozzle flow $F_n$ and excess flow $F_e$ directed to the collector 30 by line 38. The flow through the pressure regulator 68 may also be directed to the reservoir 30 through line 38' or back to the tank 10 or pump inlet 18 in a manner similar to that of the embodiment of FIG. 2C. The two flow divider system of FIG. 2D allows the use of an excess capacity pump with an increased flow $F_p$ while at the same time utilizing the reservoir type flow divider of FIG. 2A. It is also noted that by utilizing the reservoir 56, any entrapped air will be compensated for automatically due to the venting of the reservoir 56.

The pump 16 utilized in the fuel system of the present invention need not be of any particular type although a constant displacement type is considered desirable. One type of pump that has particular advantages for use in the flow divider systems of FIGS. 2C and 2D is taught in U.S. Pat. No. 4,255,093 Erikson, issued Mar. 10, 1981, and provides both combined lift and metering functions. This type of pump is shown in cross section in FIG. 3 and has an inlet 18 which supplies fuel to the sector gear pumping mechanism which consists of a shaft driven internal gear 80 which in turn drives an external drive 82 at a reduced RPM relative to the internal gear 80. This gear pumping mechanism provides gear pump pressure to a pump kidney 84 which is connected by line 86 to the adjustable pressure regulator valve 68 which is also schematically shown in FIGS. 2B, 2C and 2D. The excess flow passed by the regulator valve 68 then passes through internal line 88 to a double threaded port 90. This double threaded port 90 is connected by an internal line 92 back to the pump inlet 18. If it is desirable to have this excess flow be diverted to the collector tank 30 of FIGS. 2B, 2C and 2D, then a small plug is threaded in the smaller internal threads of port 90 to divert the flow outwardly from the pump casing to line 38 connected to the port 90. This same interconnection is used if the excess pump flow is to be diverted through line 40 back to tank 10 with line 40 connected to port 90. If it is desired to have internal pump recirculation of the excess fuel flow such as through lines 40 and 42 as shown in FIG. 1, then the small plug is removed and a large plug is threaded into the larger threads of port 90 so that the flow through line 88 passes through line 92 back to the inlet 18 of the pump. It is also noted that the line 86 connecting the pumping mechanism with the pressure regulating valve 68 may be provided with a bleed valve 94 which is used to purge the fuel system of air bubbles upon pump start-up.

In order to provide a metering function, the external gear 82 at the root of one or more spaced gear teeth is provided with a bore 96 which passes through the external gear 82. The pump is also provided with a timing port 98 which is in communication with a pump discharge passage 100 which would be connected to line 24 of FIG. 1. If the embodiment of FIGS. 2A or 2B is utilized, the pump would provide no metering function and timing port 98 would be directly connected to the pump outlet kidney 84 to provide a continuous flow of pressurized fluid through the discharge passage 100. When the pump is used in this manner, there is no need for the metering port or ports 96. However, if the pump is also used as a metering pump as represented by the embodiments of 2C and 2D, the metering port or ports 96 are used to periodically connect the pump outlet kidney 84 with the timing port 98. Thus the function of the metering orifice 78 in FIGS. 2C and 2D is provided by the pump itself through the cooperation of the metering ports 96 with the timing port 98. To increase the output flow of the pump 16 and still maintain the metering function, the number of metering ports 96 is increased.

Figure 3:
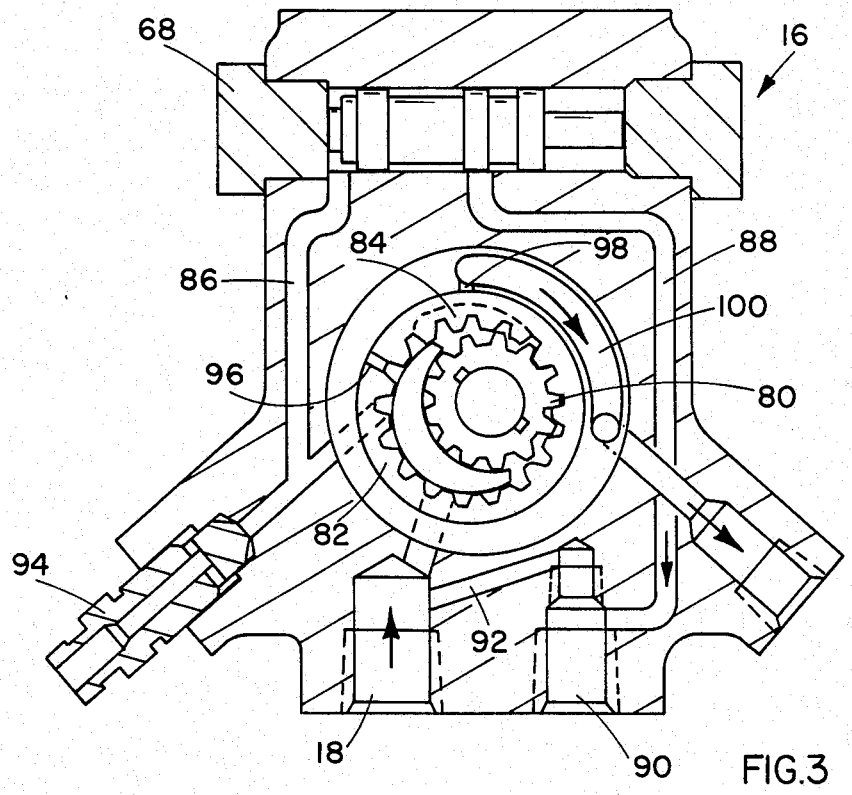
FIG. 3 is a sectional view of a lift and metering pump particularly adapted to be utilized in the system of FIG. 1.

It can thus be seen that the pump of FIG. 3 not only provides the normal lift function, but has the particular advantages of also providing both pressure regulation and a metering function all built into the pump itself. Furthermore, by selectively plugging the port 90 either internal recirculation or external recirculation of the excess pump flow may be selected.

It can be seen from the above description that a fuel flow system for a recirculating burner has been provided wherein the recirculating flow can be positively modulated to meet the objects discussed above. The preferred embodiment provides a compact system which does not require specific placement of the pump relative to the fuel burner, provides several optional flow paths, and allows the use of a large diameter tank line which provides a large flow for system start-up with a timed metered high capacity make-up fuel flow. While the system described is in the preferred form of practicing the invention, it is not to be limiting of the scope of the present invention as claimed below.

We claim:

1. A fuel supply system for a recirculating fuel burner, said recirculating fuel burner being of the type that requires a burner fuel flow in excess of the fuel burnt and wherein the excess fuel may be recirculated for further use, the fuel supply system including a pump having a flow capacity equal to or greater than the burner fuel flow, a fuel supply, a supply line connecting said supply to an inlet of said pump, said pump being upstream of said burner and providing fuel flow to said burner, a collector downstream of said burner for collecting the excess fuel, a return line connecting said collector and said inlet of said pump, valve means controlling the flow from both said supply line and said return line to said inlet of said pump wherein said supply line is normally closed by said valve means and said return line is normally open, a fuel level sensing means sensing a level of fuel in said collector and operatively connected to said valve means whereby said sensing means causes said valve means to open said supply line and close said return line upon sensing said level of fuel in said collector reaching a predetermined level, and including a flow divider positioned downstream of said pump and upstream of said burner, said flow divider directing part of the flow of said pump to said burner and diverting the remainder of the flow of said pump away from said burner.

2. The fuel supply system of claim 1 wherein said supply line has a flow capacity at least equal to said pump flow capacity.

3. The fuel supply system of claim 1 wherein said valve means is a three way solenoid valve and said sensing means provides an electrical signal responsive to the level of fuel in said collector.

4. The fuel supply system of claim 1 wherein the pump flow diverted from said burner is directed to said collector.

5. The fuel supply system of claim 1 wherein the pump flow diverted from said burner is directed to said inlet of said pump.

6. The fuel supply system of claim 1 wherein the pump flow diverted from said burner is directed to said fuel supply.

7. The fuel supply system of claim 1 wherein said flow divider includes a reservoir for receiving the flow of said pump and having lower and upper outlets, wherein flow through said lower outlet is directed to said burner and flow through said upper outlet is diverted from said burner.

8. The fuel supply system of claim 7 wherein said upper outlet is provided with a variable flow restricter.

9. The fuel supply system of claim 7 including a metering restriction in series between said pump and said reservoir and a pressure regulator in parallel with said metering restriction.

10. The fuel supply system of claim 1 wherein said flow divider includes a pressure responsive and viscosity compensating valve for controlling that part of pump flow directed to said burner, said flow divider valve increasingly restricting flow to said burner upon an increase in pump outlet pressure and supplying constant flow to said burner irrespective of fuel density and viscosity.

11. The fuel supply system of claim 1 wherein said flow divider includes a metering restriction and a pressure regulator in parallel, said part of said pump flow being directed to said burner flowing through said metering restriction.

12. A fuel supply system for a recirculating fuel burner, said recirculating fuel burner being of the type that requires a burner fuel flow $F_n$ greater than the fuel fired $F_f$ and wherein the excess burner flow ($F_n$-$F_f$) may be recirculated for further use, the fuel supply system including a pump upstream of said burner and having a flow capacity $F_p$ equal to or greater than $F_n$, a fuel tank providing a supply of fuel, a tank line connecting said tank to an inlet of said pump and having a flow capacity equal to or greater than $F_p$, a flow divider connected to an output of said pump and providing a flow $F_n$ directed to said burner and an excess pump flow $F_e$ diverted from said burner wherein $F_n+F_e=F_p$, a collector downstream of said burner for collecting excess burner flow ($F_n$-$F_f$), a return line connecting said collector and said inlet of said pump, a valve controlling the flow from both said tank line and said return line to said pump inlet wherein said tank line is normally closed by said valve and said return line is normally open, and a fuel level sensing means sensing the level of fuel in said collector and operatively connected to said valve whereby said sensing means causes said valve to fully open said tank line and totally close said return line upon sensing the level of fuel in said collector reaching a predetermined level.

13. The fuel supply system of claim 12 wherein said valve is a three way solenoid valve and said sensing means provides an electrical signal responsive to the level of fuel in said collector.

14. The fuel supply system of claim 12 wherein said excess pump flow $F_e$ diverted from said burner is directed to said collector to be returned to said pump inlet by said return line.

15. The fuel supply system of claim 12 wherein said excess pump flow $F_e$ diverted from said burner is directed to said pump inlet for recirculation through said pump.

16. The fuel supply system of claim 12 wherein said excess pump flow $F_e$ diverted from said burner is directed to said tank.

* * * * *